US008851533B2

(12) United States Patent
Akizuki et al.

(10) Patent No.: US 8,851,533 B2
(45) Date of Patent: Oct. 7, 2014

(54) VEHICLE DOOR LOCKING DEVICE

(75) Inventors: Ryujiro Akizuki, Novi, MI (US); Takashi Nishio, Kariya (JP); Yusuke Yamada, Chiryu (JP); Sho Sannohe, Chiryu (JP); Kazunori Kojima, Aichi-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/256,548

(22) PCT Filed: Mar. 25, 2010

(86) PCT No.: PCT/JP2010/055993

§ 371 (c)(1),
(2), (4) Date: Sep. 14, 2011

(87) PCT Pub. No.: WO2010/110492

PCT Pub. Date: Sep. 30, 2010

(65) Prior Publication Data

US 2012/0001442 A1 Jan. 5, 2012

(30) Foreign Application Priority Data

Mar. 27, 2009 (JP) ..... 2009-079998

(51) Int. Cl.

| | |
|---|---|
| ***E05C 3/06*** | (2006.01) |
| ***E05B 77/26*** | (2014.01) |
| ***E05B 65/00*** | (2006.01) |
| ***E05B 83/36*** | (2014.01) |
| *E05C 3/16* | (2006.01) |

(52) U.S. Cl.

CPC ..... *E05B 77/26* (2013.01); *E05B 65/00* (2013.01); *E05B 83/36* (2013.01)

USPC ..... 292/200; 292/201; 292/216

(58) Field of Classification Search

USPC ..... 292/200, DIG. 51, DIG. 55, 201, 216

See application file for complete search history.

(56) References Cited

U.S. PATENT DOCUMENTS 5,308,128 A * 5/1994 Portelli et al. ..... 292/216
5,802,894 A * 9/1998 Jahrsetz et al. ..... 70/264

(Continued)

FOREIGN PATENT DOCUMENTS

CN 1122869 A 5/1996
CN 2635841 Y 8/2004

(Continued)

OTHER PUBLICATIONS

International Search Report (PCT/ISA/210) issued on Aug. 3, 2010, by Japanese Patent Office as the International Searching Authority for International Application No. PCT/JP2010/055993.

(Continued)

*Primary Examiner* — Kristina Fulton
*Assistant Examiner* — Faria Ahmad
(74) *Attorney, Agent, or Firm* — Buchanan Ingersoll & Rooney PC

(57) ABSTRACT

A vehicle door locking device Ao is integrated by assembling a base unit A2 provided with a latch mechanism A2*a* to a housing unit A1 provided with an actuating mechanism for actuating the latch mechanism A2*a*. A metal sub-base plate 27 of the base unit A2 has an attachment hole 27*a* fitted to a support shaft 11*a* provided in the housing unit A1 in the axial direction thereof, the support shaft extending in the vehicle length direction. The attachment hole 27*a* of the metal sub-base plate 27 is fitted to the support shaft 11*a*, so that the base unit A2 is integrated with the housing unit A1. The metal sub-base plate 27 is provided with a receiving portion 27*b* for restraining a lean in the vehicle width direction (W direction) of a child-proof lever 36 at a back part of the child-proof lever 36.

5 Claims, 22 Drawing Sheets

(56) References Cited

U.S. PATENT DOCUMENTS

| | | | | |
|---|---|---|---|---|
| 5,918,917 | A * | 7/1999 | Elton et al. | 292/201 |
| 5,938,252 | A * | 8/1999 | Uemura et al. | 292/201 |
| 6,019,402 | A * | 2/2000 | Arabia et al. | 292/216 |
| 6,053,543 | A * | 4/2000 | Arabia et al. | 292/201 |
| 6,079,757 | A * | 6/2000 | Aubry | 292/201 |
| 6,328,353 | B1 * | 12/2001 | Barczynski et al. | 292/216 |
| 6,428,058 | B1 * | 8/2002 | Graute | 292/216 |
| 6,554,329 | B1 * | 4/2003 | DeBlock et al. | 292/216 |
| 6,575,506 | B2 * | 6/2003 | Hayakawa et al. | 292/216 |
| 6,880,866 | B2 * | 4/2005 | Tomaszewski et al. | 292/216 |
| 6,951,355 | B2 * | 10/2005 | Hayakawa et al. | 292/201 |
| 7,264,283 | B2 * | 9/2007 | Stoof et al. | 292/216 |
| 7,380,845 | B2 | 6/2008 | Suzumura et al. | |
| 7,559,586 | B2 * | 7/2009 | Fukunaga et al. | 292/216 |
| 7,568,740 | B2 * | 8/2009 | Brose et al. | 292/216 |
| 7,607,702 | B2 * | 10/2009 | Pereverzev | 292/216 |
| 7,625,020 | B2 * | 12/2009 | Fujimatsu et al. | 292/216 |
| 7,637,542 | B2 * | 12/2009 | Suzumura et al. | 292/216 |
| 8,109,542 | B2 * | 2/2012 | Okada et al. | 292/201 |
| 2003/0006618 | A1 * | 1/2003 | Kalsi | 292/201 |
| 2003/0116977 | A1 * | 6/2003 | Erices | 292/201 |
| 2004/0239124 | A1 * | 12/2004 | Larsen et al. | 292/201 |
| 2005/0087129 | A1 * | 4/2005 | Kitano et al. | 118/666 |
| 2006/0087129 | A1 * | 4/2006 | Gotou et al. | 292/216 |
| 2006/0131894 | A1 * | 6/2006 | Graute | 292/216 |
| 2006/0157989 | A1 * | 7/2006 | Graute | 292/216 |
| 2006/0186675 | A1 * | 8/2006 | Suzumura et al. | 292/216 |
| 2006/0186676 | A1 * | 8/2006 | Fukunaga et al. | 292/216 |
| 2006/0290142 | A1 * | 12/2006 | Tani et al. | 292/201 |
| 2007/0210587 | A1 * | 9/2007 | Inoue et al. | 292/201 |
| 2007/0210588 | A1 * | 9/2007 | Cetnar | 292/216 |
| 2008/0023971 | A1 * | 1/2008 | Akizuki et al. | 292/201 |
| 2008/0203737 | A1 * | 8/2008 | Tomaszewski et al. | 292/216 |
| 2009/0243309 | A1 * | 10/2009 | Takahashi et al. | 292/201 |
| 2009/0267359 | A1 * | 10/2009 | Takayanagi et al. | 292/201 |

FOREIGN PATENT DOCUMENTS

| | | | |
|---|---|---|---|
| CN | 2849068 | Y | 12/2006 |
| CN | 101082255 | A | 12/2007 |
| CN | 201190478 | Y | 2/2009 |
| JP | 2003-328623 | A | 11/2003 |
| JP | 2006-233456 | A | 9/2006 |
| JP | 2008-214935 | A | 9/2008 |

OTHER PUBLICATIONS

Written Opinion (PCT/ISA/237) issued on Aug. 3, 2010, by Japanese Patent Office as the International Searching Authority for International Application No. PCT/JP2010/055993.

Notification of the First Office Action dated Jun. 5, 2013 issued by the State Intellectual Property Office of People's Republic of China in corresponding Chinese Patent Application No. 201080013771.4 and English language translation (12 pages).

* cited by examiner

VEHICLE DOOR LOCKING DEVICE

BACKGROUND OF THE INVENTION

1. Technical Field

The present invention relates to a vehicle door locking device.

2. Related Art

One of vehicle door locking devices is shown in Japanese Patent Publication No. 2006-233456. This vehicle door locking device includes a base unit adapted to be installed in a vehicle door and provided with a latch mechanism for retaining the vehicle door in a closed state relative to a vehicle body, a housing unit provided with an actuating mechanism for actuating the latch mechanism, and a child-proof lever provided in the housing unit. The child-proof lever is assembled to the housing unit oscillatably on an axis extending in the vehicle width direction (W direction) when the housing unit is installed in the vehicle door through the base unit. The child-proof lever is manually operable. The base unit and the housing unit are integrated.

SUMMARY OF THE INVENTION

In the vehicle door locking device described in the above patent document, as well as a conventional vehicle door locking device Bo shown in FIGS. 16 to 22, a base unit B2 is assembled to a housing unit B1, so that the housing unit B1 and the base unit B2 are integrated. The housing unit B1 is provided with a child-proof lever 101. The child-proof lever 101 is assembled to the housing unit B1 oscillatably (swingably) on an axis extending in the vehicle width direction (W direction) when the housing unit B1 is installed in the vehicle door through the base unit B2. The child-proof lever is manually operable. The housing unit is also provided with an actuating mechanism B1*a* for actuating a latch mechanism B2*a*.

The child-proof lever 101 is pivotably (rotatably) assembled to the housing unit B1 at a shaft portion 101*a* extending in the vehicle width direction (W direction), and an operation knob 101*b* thereof protrudes toward the inside of the door. This child-proof lever 101 enables operation of an inside lever 102 actuated in connection with an inside handle in a child-lock unlocked state shown in FIG. 16, and disables the operation of the inside lever 102 in a child-lock locked state (state where the child-proof lever is pivoted clockwise by a predetermined amount from a state shown in FIG. 16), and can be manually pivoted by the operation knob 101*b*.

The base unit B2 is provided with the latch mechanism B2*a*, and also provided with a metal sub-base plate 103 for assembling the base unit B2 to the housing unit B1. A cutout hole 103*a* opening toward one side (right side in FIG. 17) in the vehicle width direction (W direction) is formed in the sub-base plate 103. This base unit B2 is integrated with the housing unit B1 by assembling the cutout hole 103*a* of the sub-base plate 103 to a support shaft 104 provided in the housing unit B1, the support shaft extending in the vehicle length direction (L direction), in the radial direction of the support shaft 104 (specifically, moving the cutout hole rightward in the W direction in FIG. 17 to fit the cutout hole).

The operation knob 101*b* of the child-proof lever 101 and the sub-base plate 103 in which the cutout hole 103*a* is formed are arranged so as to be overlapped with each other in the vehicle length direction (L direction) as is clear from FIGS. 16 and 17. Thus, in the case where the housing unit B1 and the base unit B2 are integrated as described above, as shown in FIG. 17, a predetermined clearance S (clearance required for integrating the housing unit B1 and the base unit B2) is generated between a back surface of an end portion of the operation knob 101*b* of the child-proof lever 101 and the sub-base plate 103.

Therefore, in this case, as shown in FIGS. 17 to 20, one part 105*a* of a resin housing 105 in the housing unit B1 protrudes toward the back surface of the end portion of the operation knob 101*b* of the child-proof lever 101, so that a lean (rightward movement in FIG. 17) in the vehicle width direction (W direction) of the child-proof lever 101 is restrained by a front end of the protruding part. However, with such a configuration, it is difficult to ensure sufficient strength in the protruding part 105*a* of the resin housing 105, and there is room for improvement as to a malfunction in which the child-proof lever 101 is pushed at the operation knob 101*b* toward a back part with large force.

The present invention is achieved in order to solve the above problem. A vehicle door locking device of the present invention includes a base unit adapted to be installed in a vehicle door and provided with a latch mechanism for retaining the vehicle door in a closed state relative to a vehicle body, a housing unit provided with an actuating mechanism for actuating the latch mechanism, a metal sub-base plate provided in the base unit for assembling the base unit to the housing unit, a child-proof lever provided in the housing unit, the child-proof lever assembled to the housing unit oscillatably on an axis extending in the vehicle width direction when the housing unit is installed in the vehicle door through the base unit, the child-proof lever being manually operable, and a receiving portion provided in the metal sub-base plate, the receiving portion being capable of being abutted with a back part of the child-proof lever.

In this case, the child-proof lever may have an operation knob integrally formed and bent toward the side of a front part of the child-proof lever, the receiving portion may be capable of being abutted with the back part of the child-proof lever at a base part of the operation knob, and a lean in the vehicle width direction of the child-proof lever may be restrained by the abutment. Further, a support shaft extending in the vehicle length direction (L direction) may be provided in the housing unit, an attachment hole may be provided in the metal sub-base plate and fitted to the support shaft in the axial direction thereof, and the base unit may be assembled to and integrated with the housing unit by fitting the attachment hole to the support shaft. Further, a positioning pin extending in the vehicle length direction may be provided in the housing unit, and a positioning hole may be provided in the metal sub-base plate and fitted to the positioning pin.

In the vehicle door locking device according to the present invention, the receiving portion capable of being abutted with the back part of the child-proof lever is provided in the metal sub-base plate of the base unit. When the child-proof lever is pushed toward the back part with large force, the back part of the child-proof lever is abutted with and received by the receiving portion of the metal sub-base plate. Therefore, a malfunction in which the child-proof lever is pushed toward the back part with large force can be addressed.

In implementation of the present invention, in the case where the child-proof lever has the operation knob integrally formed therewith and bent toward the side of the front part of the child-proof lever, the receiving portion is capable of being abutted with the back part of the child-proof lever at the base part of the operation knob, and the lean in the vehicle width direction of the child-proof lever is restrained by the abutment, operation force at the time of pushing the operation knob of the child-proof lever toward the back part can be directly received by the receiving portion of the metal sub-base plate.

In the implementation of the present invention, in the case where the support shaft extending in the vehicle length direction (L direction) is provided in the housing unit, the attachment hole is provided in the metal sub-base plate and fitted to the support shaft in the axial direction thereof, and the base unit is assembled to and integrated with the housing unit by fitting the attachment hole to the support shaft, the receiving portion (holding portion) of the metal sub-base plate can be arranged in the vicinity of the back part of the child-proof lever without impairing a property of assembling the base unit to the housing unit, so that a malfunction in which the child-proof lever is pushed toward the back part with large force can be properly addressed.

In the implementation of the present invention, in the case where the positioning pin extending in the vehicle length direction is provided in the housing unit, and the positioning hole is provided in the metal sub-base plate and fitted to the positioning pin, precision in assembling the base unit to the housing unit can be improved without impairing the property of assembling the base unit to the housing unit.

DETAILED DESCRIPTION OF THE INVENTION

Figure 15:
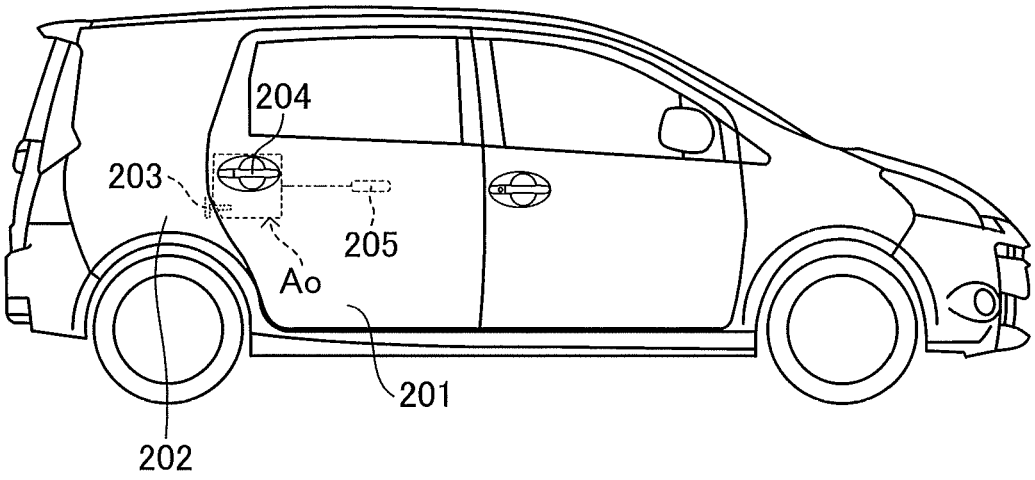
FIG. 15 is a right side view of a vehicle including the vehicle door locking device shown in FIGS. 1 to 4.
Figure 16:
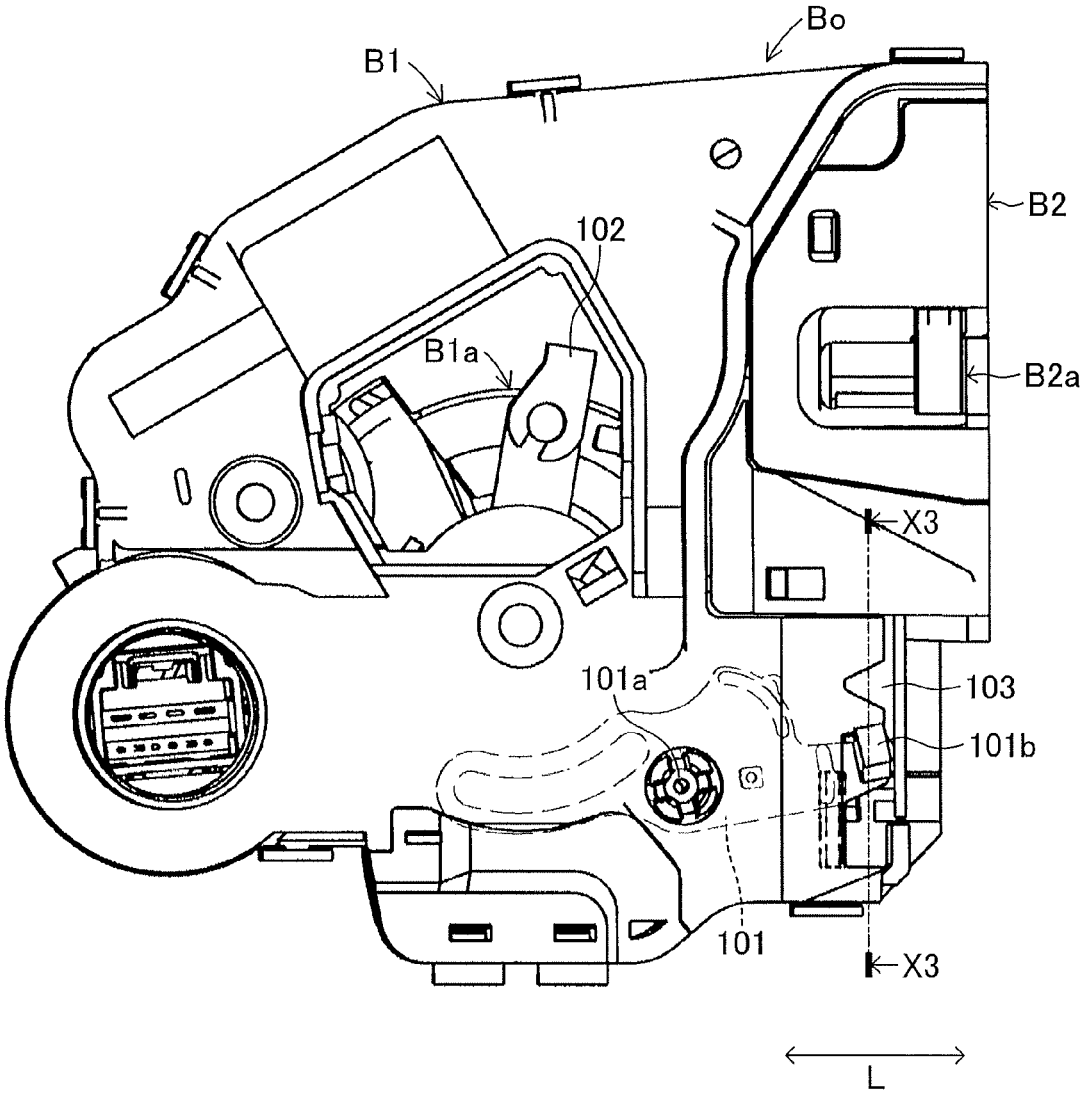
FIG. 16 is a side view of a conventional vehicle door locking device, the view seen from the inside of a door.
Figure 17:
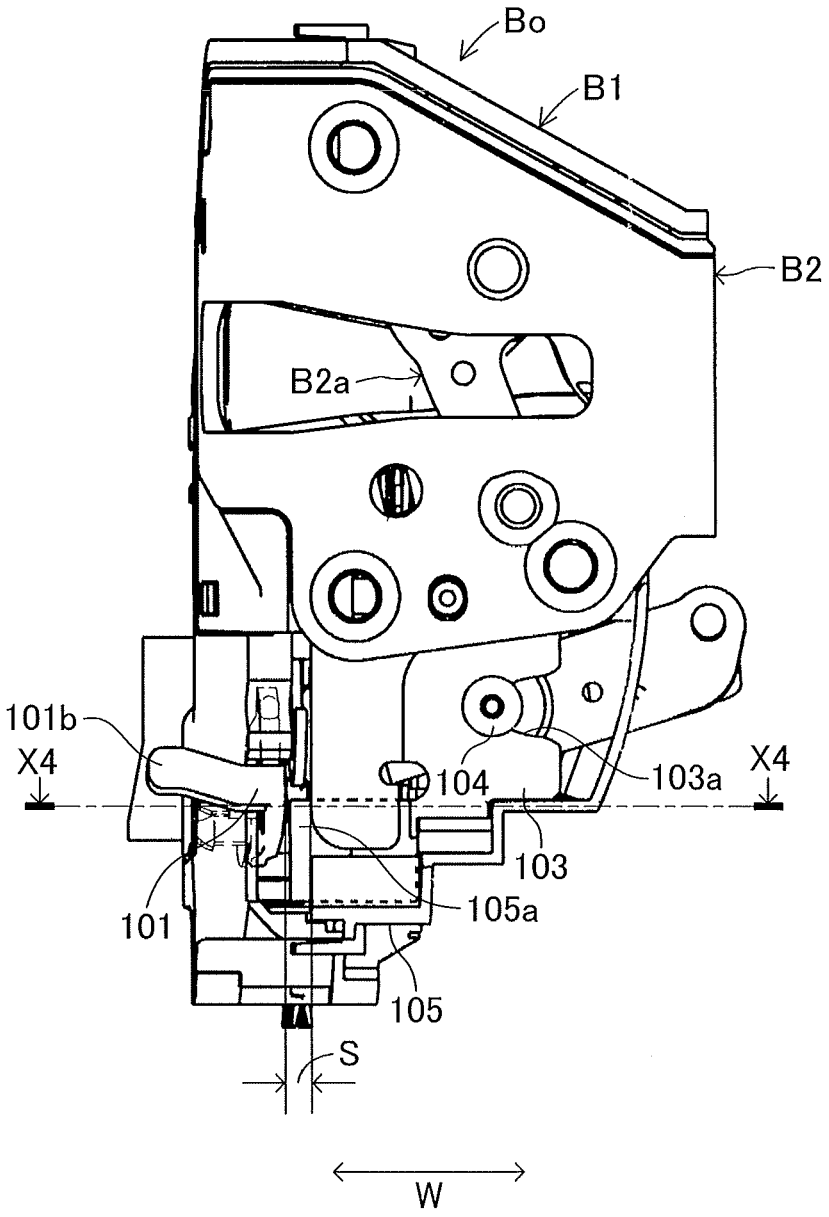
FIG. 17 is a side view of the conventional vehicle door locking device, the view seen from the rear side of the door.

Hereinafter, one embodiment of the present invention will be described with a reference to the drawings. FIGS. 1 to 15 show a vehicle door locking device Ao according to the present invention. This vehicle door locking device Ao is installed in a vehicle door 201 (refer to FIG. 15) mounted on the rear right side of a vehicle. As shown in FIGS. 1 to 4, the vehicle door locking device Ao is integrated by assembling a base unit A2 to a housing unit A1. The housing unit A1 is provided with a resin child-proof lever 36 assembled to the housing unit A1 oscillatably on an axis extending in the vehicle width direction (W direction) when the housing unit A1 is installed in the vehicle door 201 through the base unit A2. The child-proof lever 36 is manually operable. The housing unit A1 is also provided with an actuating mechanism A1*a* (refer to FIG. 6) for actuating a latch mechanism A2*a* (refer to FIG. 5) built into the base unit A2.

The latch mechanism A2*a* is to retain the vehicle door 201 in a closed state (state where the door is closed) relative to a vehicle body 202. The latch mechanism A2*a* is provided with a latch 21 engageable with a striker 203 fixed to the vehicle body 202. This latch mechanism A2*a* is engaged with the striker 203 so as to retain the vehicle door 201 in the closed state (latch state). A state of the vehicle door is changed from the closed state to an open state (state where the door is openable from the vehicle body) (unlatch state) by disengaging the latch mechanism A2*a* from the striker 203.

Figure 5:
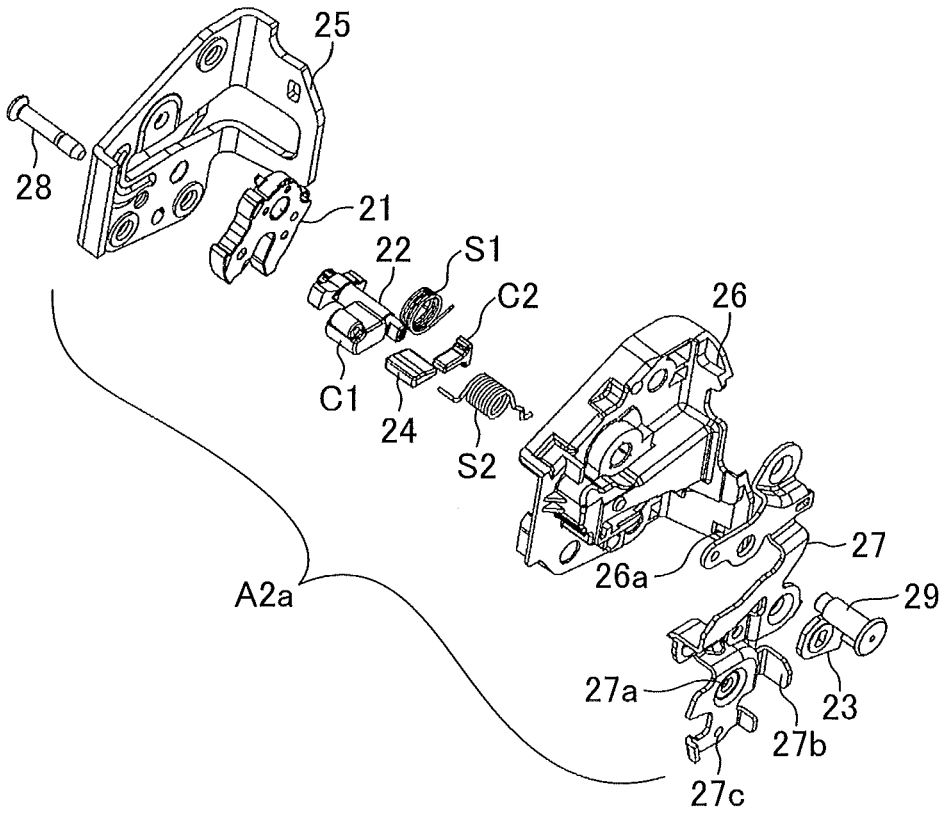
FIG. 5 is an exploded perspective view of a base unit of the vehicle door locking device shown in FIGS. 1 to 4.

As shown in an exploded view of FIG. 5, the latch mechanism A2*a* is provided with the latch 21, a pole 22, a lift lever 23, and a stopper 24, and also provided with cushions C1, C2, a latch torsion spring S1, and a pole torsion spring S2. These constituent elements are assembled to a metal base plate 25, a resin case 26, and a metal sub-base plate 27 using a screw 28 and a pin 29 so as to form the base unit A2 (refer to FIGS. 12 to 14).

Figure 6:
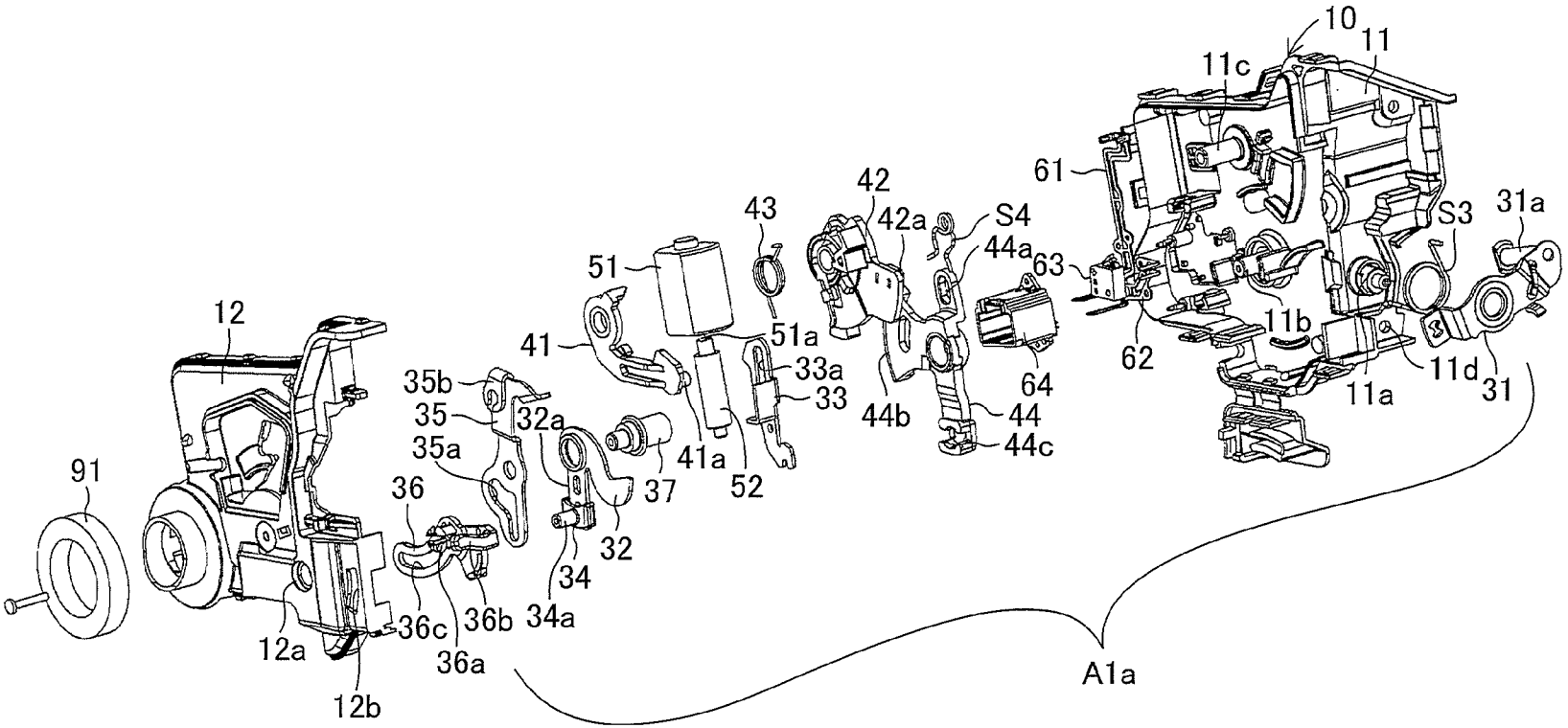
FIG. 6 is an exploded perspective view of a housing unit of the vehicle door locking device shown in FIGS. 1 to 4.

The actuating mechanism A1*a* is formed by constituent elements shown in FIG. 6. The actuating mechanism A1*a* comprises an open mechanism for actuating the latch mechanism A2*a* from the latch state to the unlatch state so that the vehicle door 201 is openable from the vehicle body 202, and a lock mechanism for regulating or permitting operation of this open mechanism so as to lock or unlock the vehicle door 201. The actuating mechanism is assembled to a housing 10. The housing 10 is provided with a housing body 11, and a housing cover 12 assembled to this housing body 11.

As shown in FIG. 6, the open mechanism is provided with an outside open lever 31, an inside open lever 32, and an open link 33, and also provided with a bushing 34, an inside lever 35, and the child-proof lever 36. The outside open lever 31 is assembled to a support shaft 11*a* provided in the housing body 11 together with a torsion spring S3. The outside open lever 31 is connected to an outside handle 204 (refer to FIG.

15) provided on the outdoor side of the vehicle door 201, and actuated by operating the outside handle 204. It should be noted that a shaft 31*a* connected to the outside handle 204 is assembled to the outside open lever 31.

The inside open lever 32 is assembled to a support shaft 11*b* provided in the housing body 11 through a pin 37. The inside open lever 32 is connected to an inside handle 205 (refer to FIG. 15) provided on the indoor side of the vehicle door 201 through the bushing 34 and the inside lever 35, and can be actuated by operating the inside handle 205 through the inside lever 35 and the bushing 34. The open link 33 is oscillatably coupled to and supported on an end of the outside open lever 31 at a lower end thereof. The open link 33 can be oscillated between an unlock position and a lock position by an active sub-lever 41 serving as a constituent element of the lock mechanism. In a state where the open link 33 is at the unlock position, the open link 33 is engageable with the lift lever 23 of the latch mechanism A2*a* so as to bring the vehicle door 201 into the opened state. In a state where the open link 33 is at the lock position, the open link 33 is not engageable with the lift lever 23 of the latch mechanism A2*a*.

Upon receiving operation of the outside open lever 31 (operated by the outside handle 204) or receiving operation of the inside open lever 32 (operated by the inside handle 205), the open link 33 is moved toward the upper side of the device. Therefore, in the closed state of the vehicle door 201, in the case where the open link 33 is at the unlock position and moved upward by receiving the operation of the outside open lever 31 or the inside open lever 32, the lift lever 23 of the latch mechanism A2*a* is pushed and pivoted by the open link 33, so that the latch mechanism A2*a* is actuated from the latch state to the unlatch state. Thereby, the state of the vehicle door 201 is changed from the closed state to the opened state. That is, when the open link 33 is at the unlock position, the vehicle door 201 is unlocked.

Meanwhile, in the closed state of the vehicle door 201, in the case where the open link 33 is at the lock position and moved upward by receiving the operation of the outside open lever 31 or the inside open lever 32, the open link 33 is not engaged with the lift lever 23 of the latch mechanism A2*a*, and the latch mechanism A2*a* remains to be retained in the latch state. Thereby, the state of the vehicle door 201 remains to be retained in the closed state. That is, when the open link 33 is at the lock position, the vehicle door 201 is locked.

As shown in FIG. 6, the bushing 34 is assembled to an arm portion 32*a* of the inside open lever 32 so as to be movable in the up and down direction of the arm portion 32*a*. The bushing 34 integrally has a pin portion 34*a* engaged with a long hole 35*a* of the inside lever 35. The inside lever 35 is pivotably assembled to the pin 37. The inside lever 35 has the above long hole 35*a* and also has a coupling portion 35*b* coupled to the inside handle 205. The long hole 35*a* of the inside lever 35 has a straight part extending in the radial direction relative to pivot center of the inside lever 35 and an arc part extending in the circumferential direction relative to the pivot center of the inside lever 35.

In a state where the pin portion 34*a* of the bushing 34 is engaged with the straight part of the long hole 35*a*, operation of the inside lever 35 is enabled, so that the inside open lever 32 can be actuated. In a state where the pin portion 34*a* of the bushing 34 is engaged with the arc part of the long hole 35*a*, the operation of the inside lever 35 is disabled, so that the inside open lever 32 cannot be actuated.

The child-proof lever 36 is pivotably assembled to a support hole 12*a* provided in the housing cover 12 at a shaft portion 36*a* extending in the vehicle width direction (W direction). An operation knob 36*b* thereof protrudes toward the inside of the vehicle door 201 through a long hole 12*b* provided in the housing cover 12. The child-proof lever 36 can be manually pivoted by the operation knob 36*b*. The operation knob 36*b* is formed by being bent by about 90 degrees toward the side of a front part of the child-proof lever 36 (inside of the door), and integrally formed in an end of the child-proof lever 36.

The child-proof lever 36 has a long hole 36*c* engaged with the pin portion 34*a* of the bushing 34. The long hole 36*c* of the child-proof lever 36 is formed into an arc shape extending in the circumferential direction relative to the pivot center of the inside lever 35 while being partly overlapped with the straight part of the long hole 35*a* of the inside lever 35, when the child-proof lever 36 is in a child-lock unlocked state shown in FIG. 2.

Figure 1:
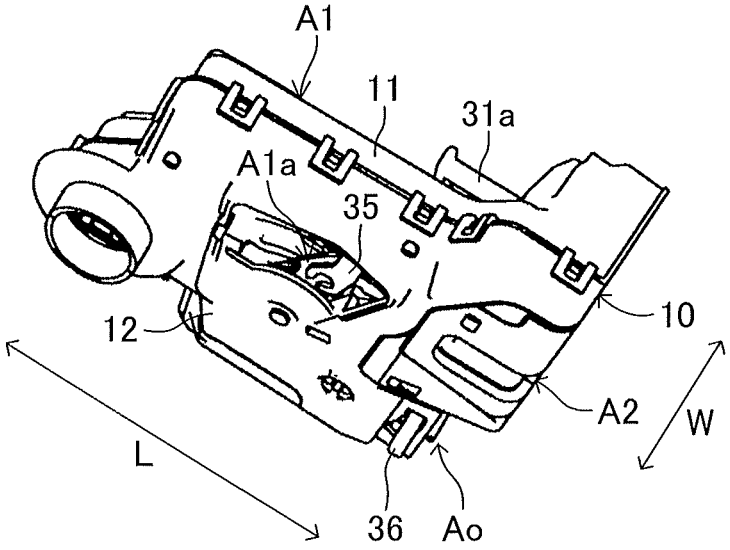
FIG. 1 is a perspective view schematically showing one embodiment of a vehicle door locking device according to the present invention.
Figure 2:
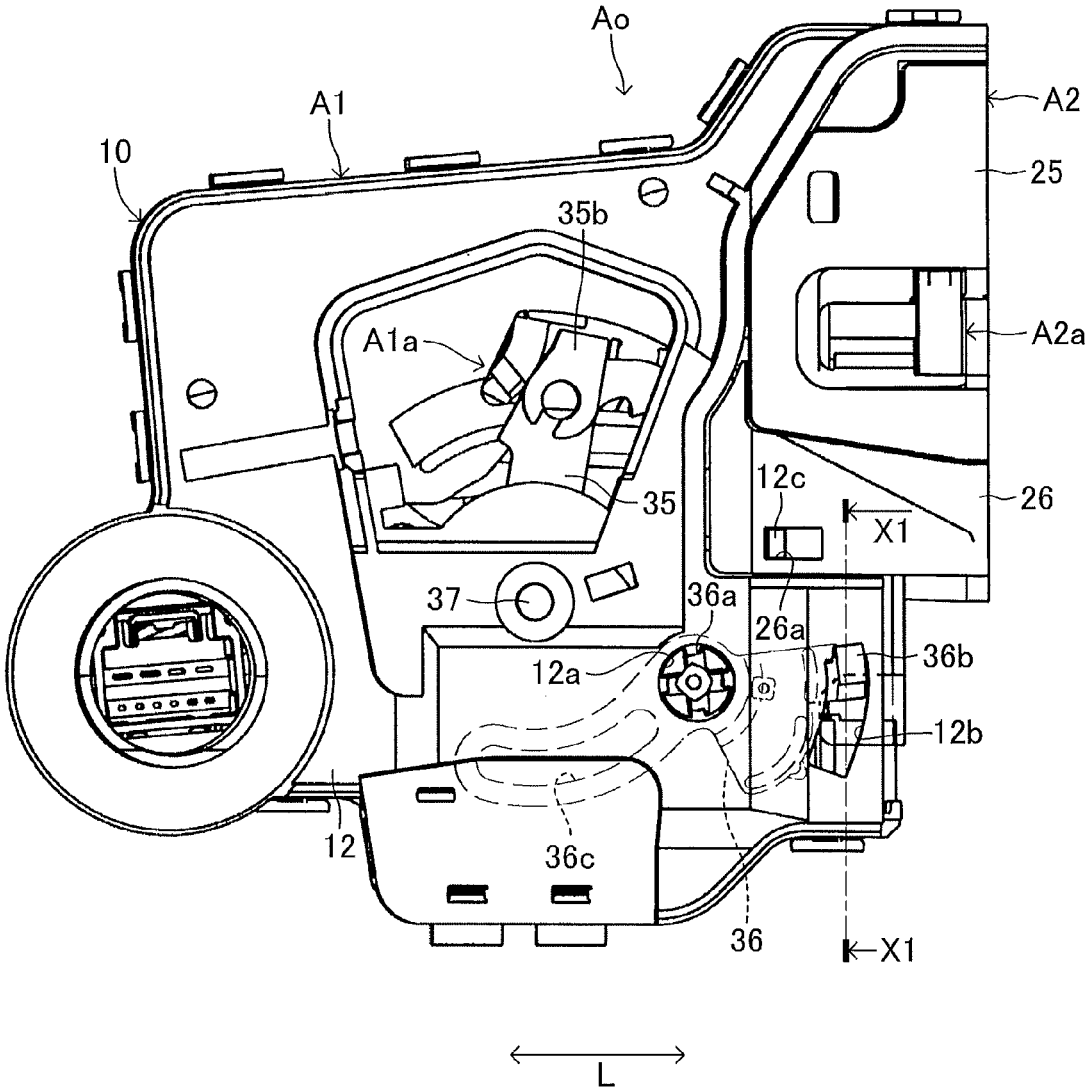
FIG. 2 is a side view of the vehicle door locking device shown in FIG. 1, the view seen from the inside of a door.
Figure 3:
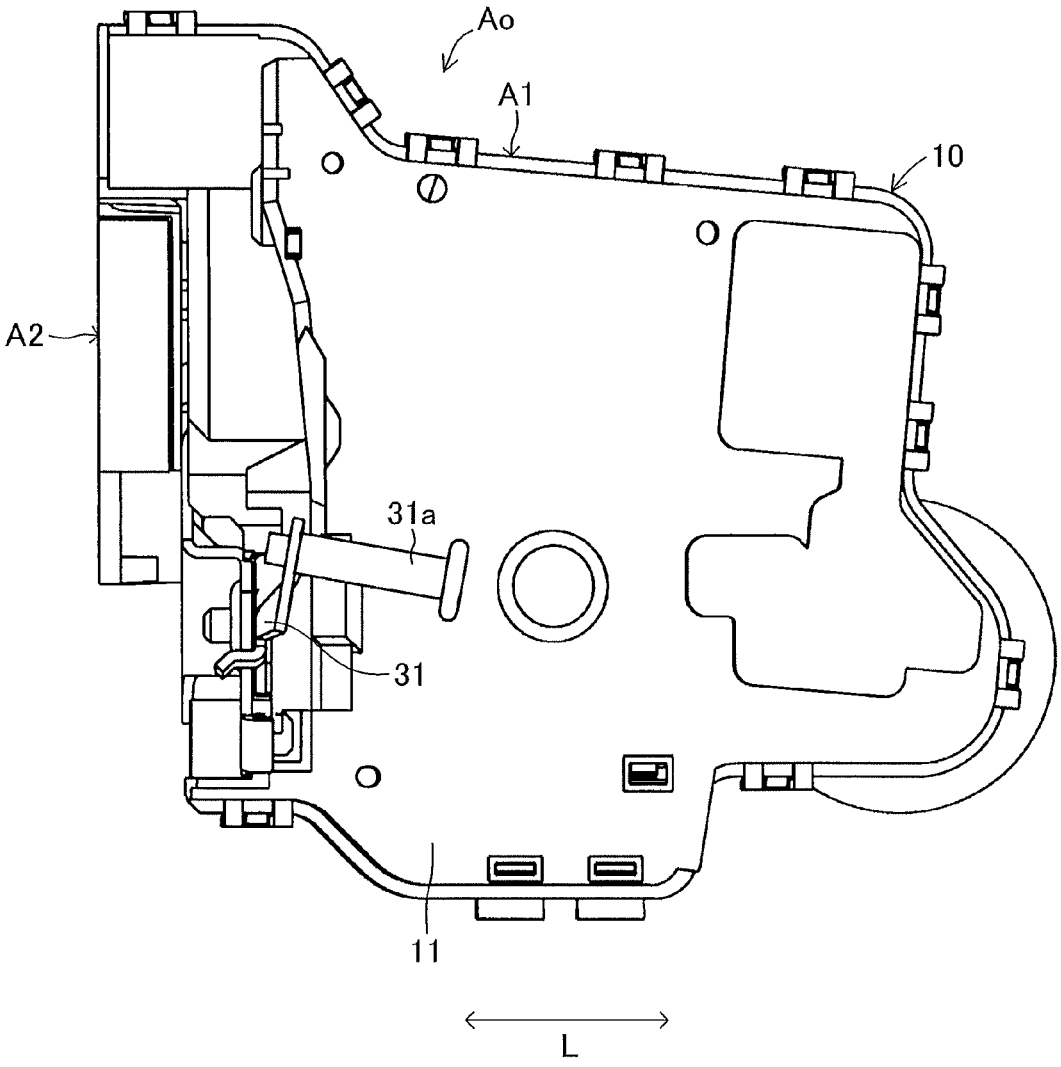
FIG. 3 is a side view of the vehicle door locking device shown in FIG. 1, the view seen from the outside of the door.
Figure 4:
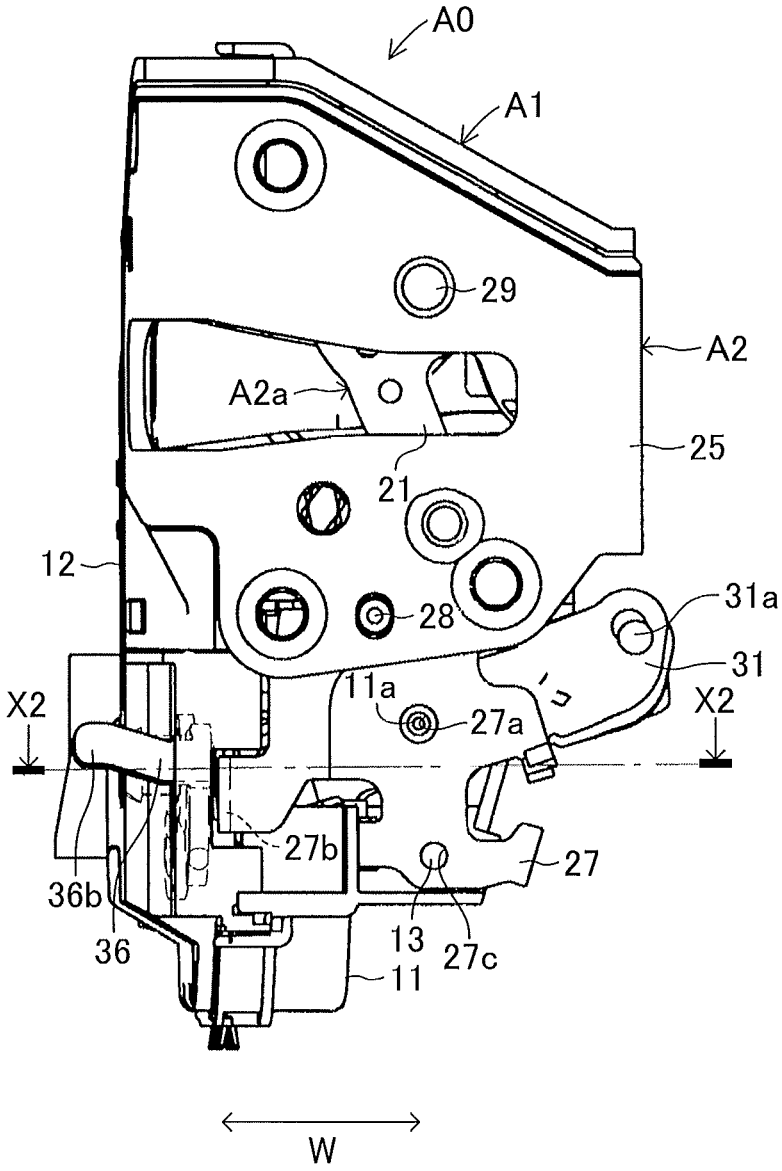
FIG. 4 is a side view of the vehicle door locking device shown in FIG. 1, the view seen from the rear side of the door.

Therefore, when the child-proof lever 36 is in the child-lock unlocked state shown in FIG. 2, the pin portion 34*a* of the bushing 34 is engaged with the straight part of the long hole 35*a* of the inside lever 35, so that the operation of the inside lever 35 is enabled. Meanwhile, when the child-proof lever 36 is in a child-lock locked state (state where the child-proof lever is pivoted clockwise by a predetermined amount from the state shown in FIG. 2), the pin portion 34*a* of the bushing 34 is engaged with the arc part of the long hole 35*a* of the inside lever 35, so that the operation of the inside lever 35 is disabled.

The lock mechanism is provided with the above active sub-lever 41, and also provided with an active main lever 42 and a twisted spring 43 assembled to a support shaft 11*c* provided in the housing body 11 together with this active sub-lever 41 and a torsion spring S4. Further, the lock mechanism is provided with a locking lever 44 and an electrically operated actuator. The active sub-lever 41 is rotatably assembled to the support shaft 11*c* while being rotatable relative to the active main lever 42 by a predetermined amount, and has an engagement pin portion 41*a* engaged with a long hole 33*a* of the open link 33.

The active main lever 42 is rotatably assembled to the support shaft 11*c*, and has an engagement portion 42*a* engaged with a long hole 44*a* of the locking lever 44. The twisted spring 43 is placed between the active main lever 42 and the active sub-lever 41 so as to bias rotation of the active sub-lever 41 relative to the active main lever 42 in one direction (anti-clockwise in FIG. 6). Therefore, the active main lever 42 and the active sub-lever 41 are integrally rotated clockwise (lock direction) in FIG. 6, and rotated through the twisted spring 43 in the unlock direction.

The electrically operated actuator is to drive the above open link 33 to the lock position or the unlock position through the locking lever 44, the active main lever 42, the twisted spring 43, and the active sub-lever 41. The electrically operated actuator is provided with an electric motor 51 and a worm 52. The electric motor 51 is a known motor driven in accordance with a locking operation and an unlocking operation, and a first terminal 61, a second terminal 62, a switch 63, a connector 64, and the like are provided for controlling operation thereof. The worm 52 is provided integrally with an output shaft 51*a* of the electric motor 51, always meshed with a sector gear 44*b* provided in the locking lever 44, and rotated and driven by the electric motor 51.

Therefore, when the worm 52 is rotated and driven by the electric motor 51, the locking lever 44 is pivoted. In accordance with this pivot of the locking lever 44, the active main lever 42, the active sub-lever 41, and the like are rotated, and this rotation is transmitted to the open link 33, so that the door is locked or unlocked. It should be noted that an operation portion 44*c* capable of being connected to a lock knob (not shown) provided on the indoor side of the vehicle door 201 is provided in the locking lever 44.

In the above vehicle door locking device Ao, the metal sub-base plate 27 of the base unit A2 has an attachment hole 27*a* fitted to the support shaft 11*a* provided in the housing body 11 of the housing unit A1. The support shaft 11*a* extends in the vehicle length direction (L direction). The attachment hole 27*a* of the metal sub-base plate 27 is fitted to the support shaft 11*a* in the axial direction thereof, so that the base unit A2 is integrated with the housing unit A1.

The metal sub-base plate 27 is provided with a receiving portion (holding portion) 27*b* abutted with a back part of the child-proof lever 36 at a base part of the operation knob 36*b* of the child-proof lever 36 so as to restrain a lean in the vehicle width direction (W direction) of the child-proof lever 36. It should be noted that the base unit A2 is retained onto the housing unit A1 by elastically engaging an engagement projection 12*c* provided in the housing cover 12 with a rectangular attachment hole 26*a* provided in the resin case 26 (refer to FIG. 2).

Therefore, the attachment hole 27*a* provided in the metal sub-base plate 27 of the base unit A2 is fitted to the support shaft 11*a* provided in the housing unit A1, so that the base unit A2 can be integrated with the housing unit A1. Thus, the receiving portion (holding portion) 27*b* of the metal sub-base plate 27 can be arranged in the vicinity of the back part of the child-proof lever 36 at the base part of the operation knob 36*b* in the child-proof lever 36 without impairing a property of assembling the base unit A2 to the housing unit A1, so that a malfunction in which the child-proof lever 36 is pushed toward the back part of the operation knob 36*b* with large force can be properly addressed.

In this embodiment, the metal sub-base plate 27 has a positioning hole 27*c* fitted to a positioning pin 13 (refer to FIGS. 7, 11) provided in the housing body 11, the positioning pin extending in the vehicle length direction (L direction). The positioning pin 13 is fitted and fixed to a pin hole 11*d* (refer to FIGS. 6, 11) provided in the housing body 11. Therefore, in this embodiment, precision in assembling the base unit A2 to the housing unit A1 can be improved without impairing the property of assembling the base unit A2 to the housing unit A1.

Figure 7:
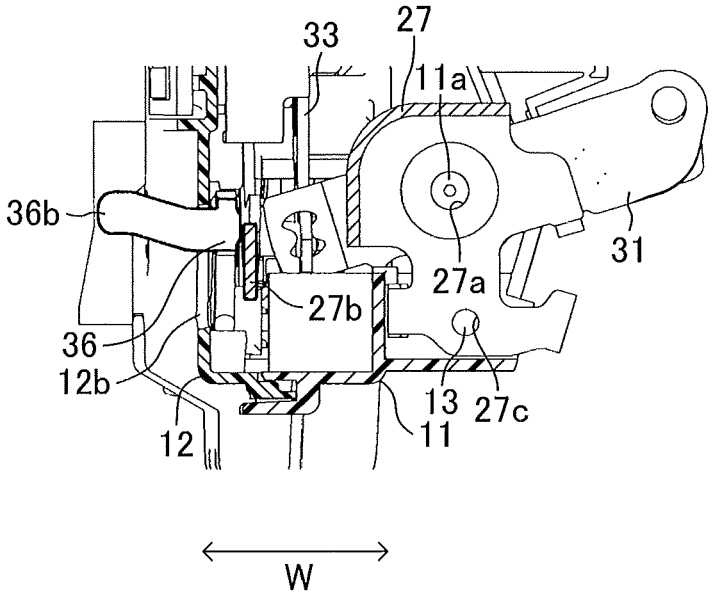
FIG. 7 is a schematic sectional view along the line X1-X1 in FIG. 2.
Figure 8:
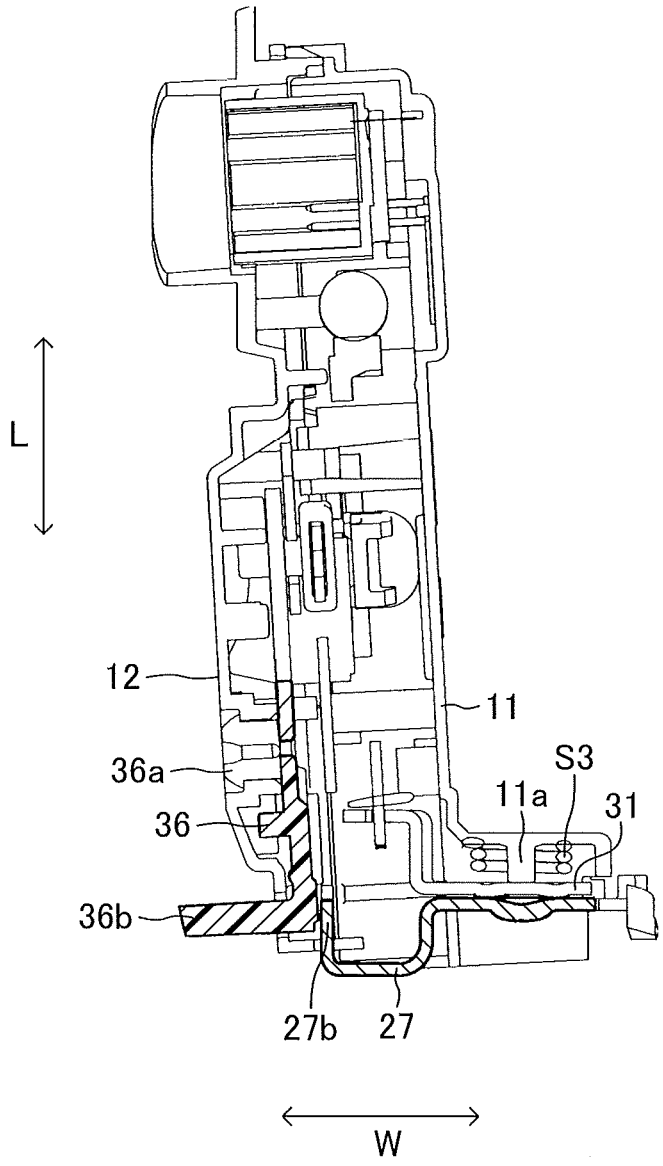
FIG. 8 is a schematic sectional view along the line X2-X2 in FIG. 4.
Figure 9:
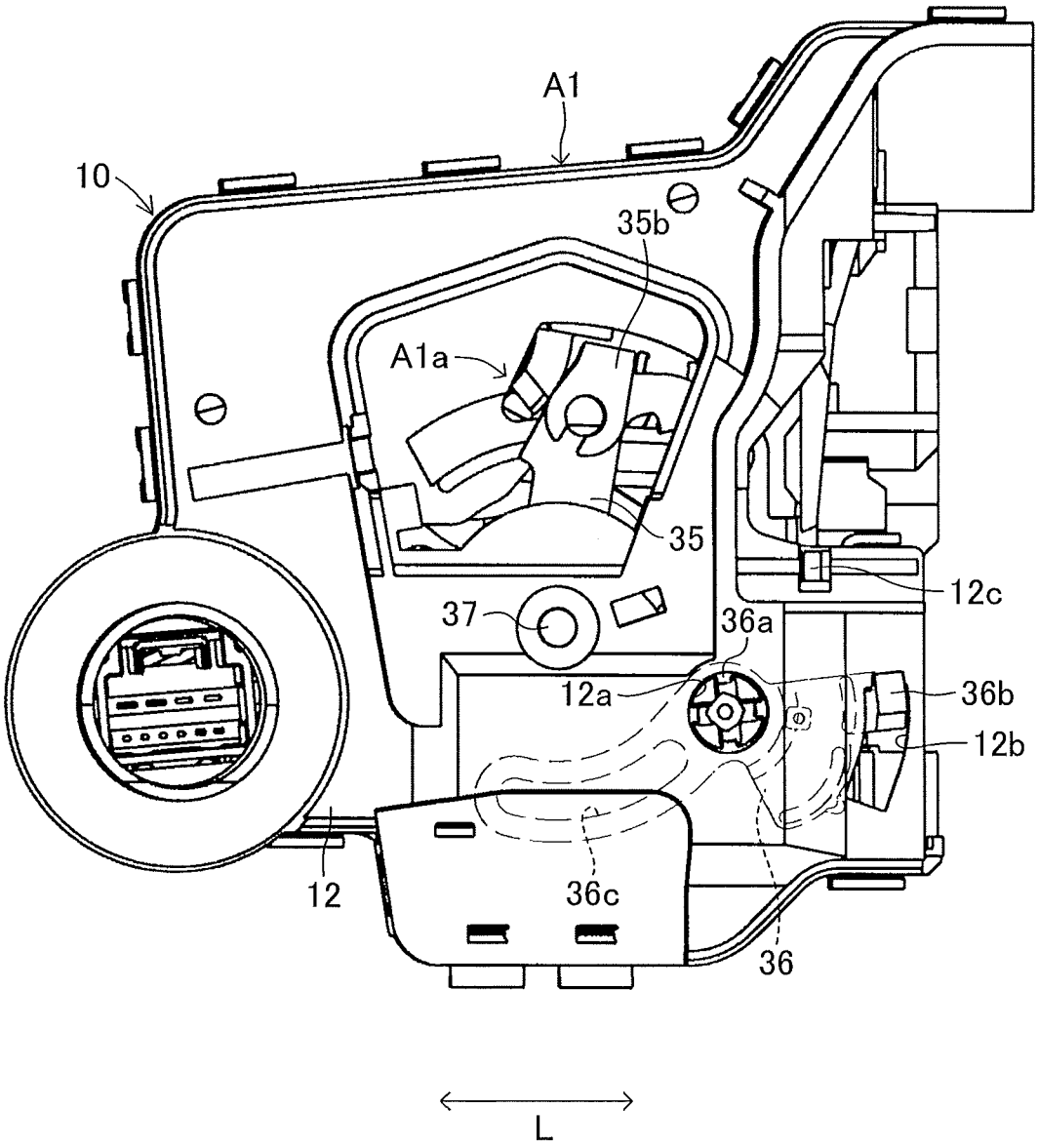
FIG. 9 is a side view of the housing unit of the vehicle door locking device shown in FIGS. 1 to 4, the view seen from the inside of the door.
Figure 10:
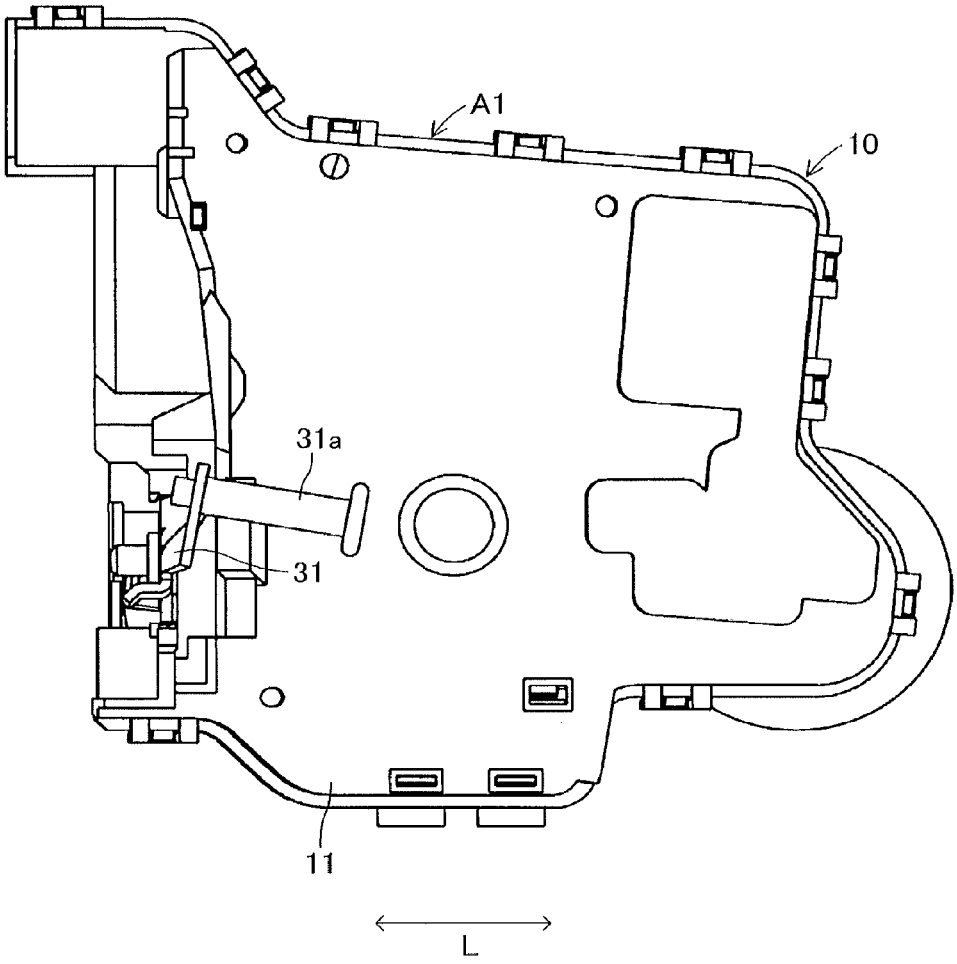
FIG. 10 is a side view of the housing unit of the vehicle door locking device shown in FIGS. 1 to 4, the view seen from the outside of the door.
Figure 11:
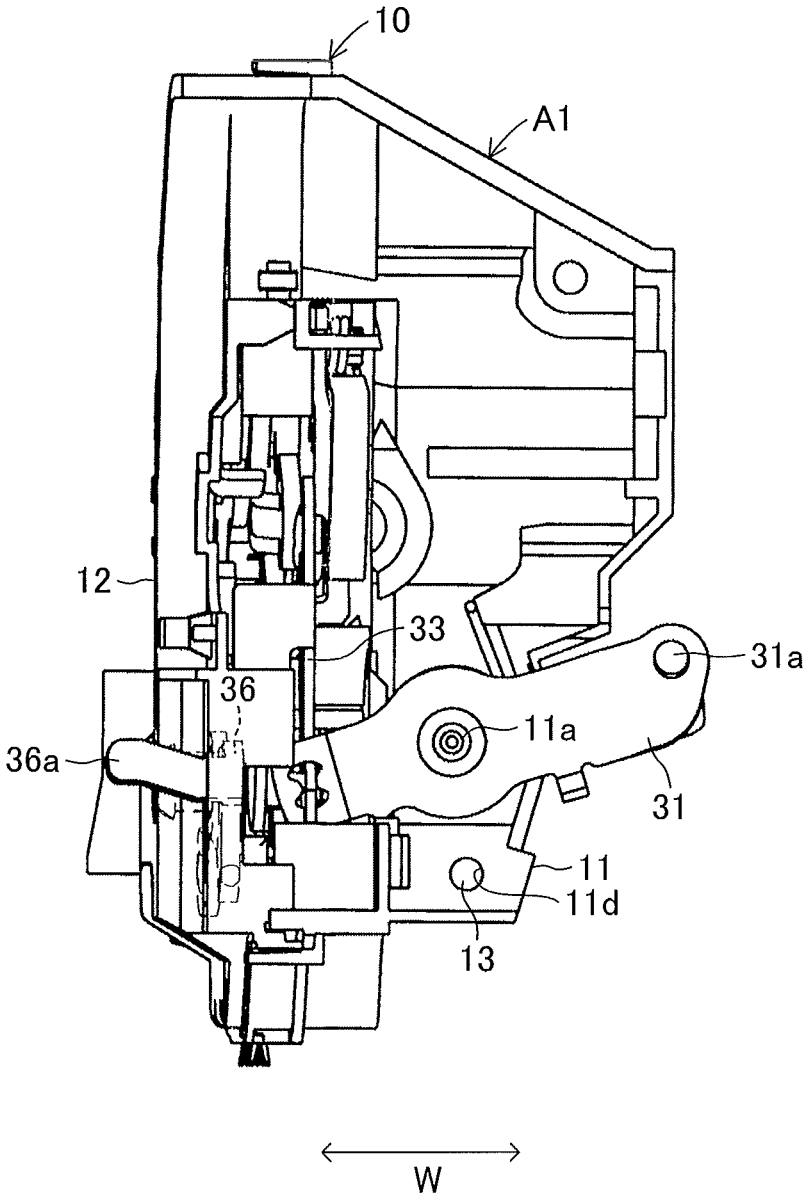
FIG. 11 is a side view of the housing unit of the vehicle door locking device shown in FIGS. 1 to 4, the view seen from the rear side of the door.
Figure 12:
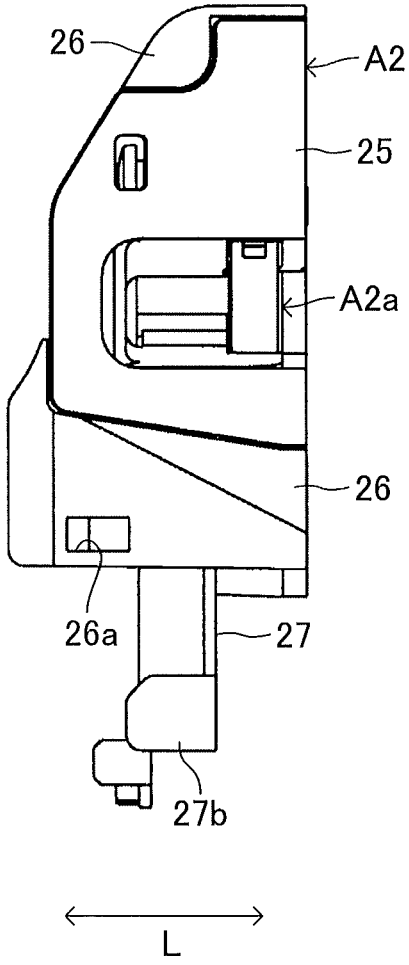
FIG. 12 is a side view of the base unit of the vehicle door locking device shown in FIGS. 1 to 4, the view seen from the inside of the door.
Figure 13:
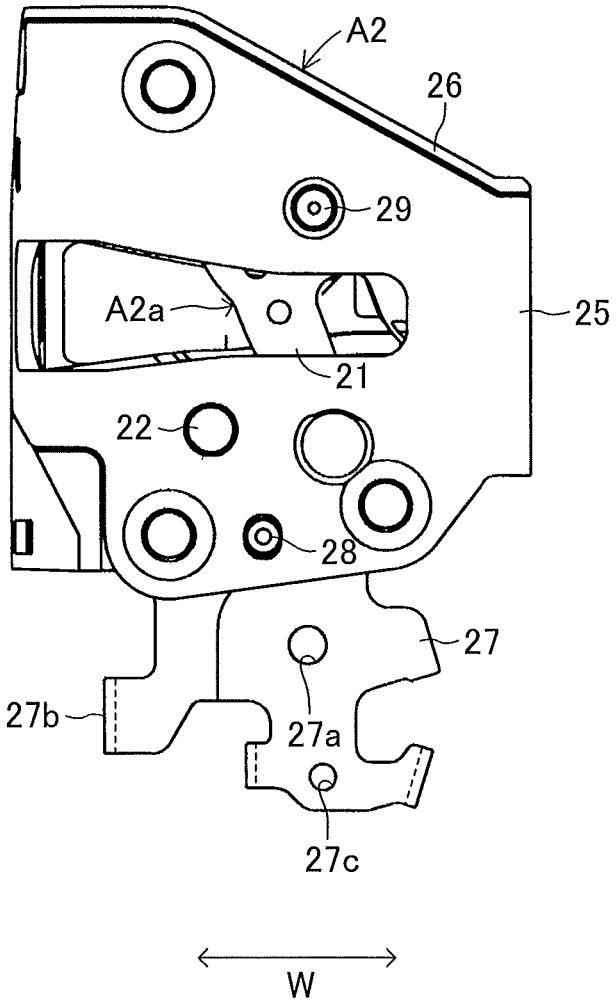
FIG. 13 is a side view of the base unit of the vehicle door locking device shown in FIGS. 1 to 4, the view seen from the rear side of the door.
Figure 14:
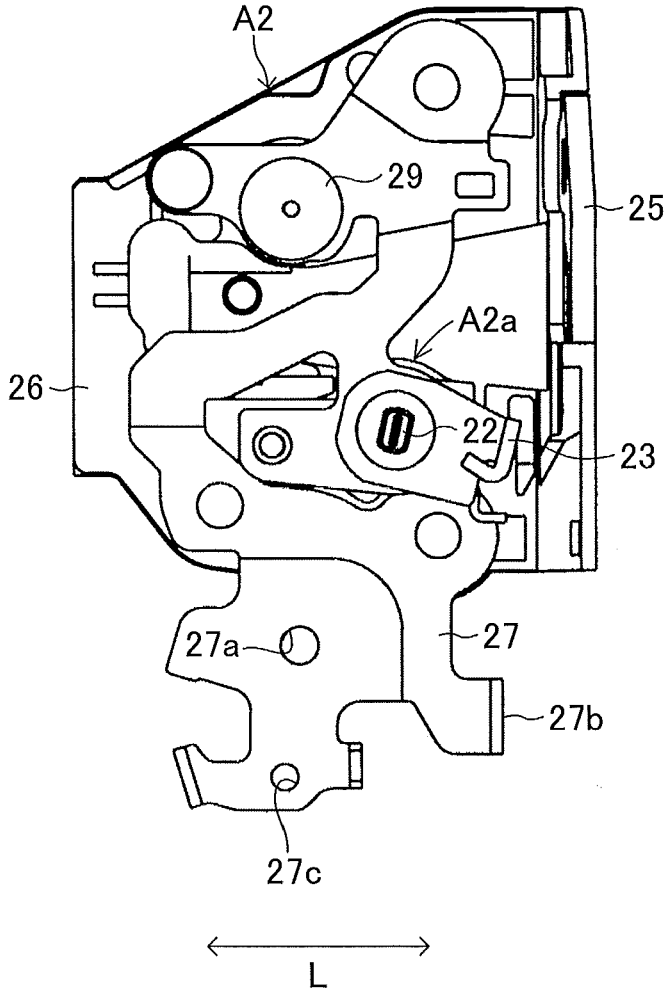
FIG. 14 is a side view of the base unit of the vehicle door locking device shown in FIGS. 1 to 4, the view seen from the front side of the door.
Figure 18:
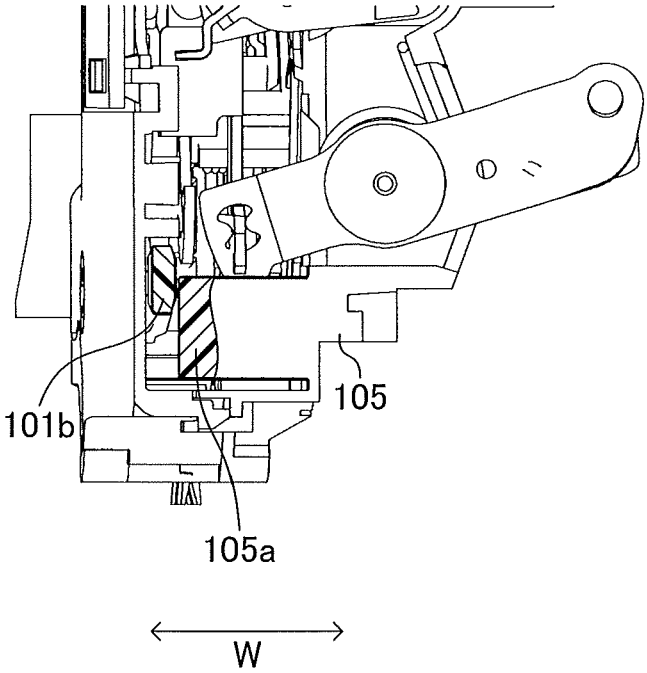
FIG. 18 is a schematic sectional view along the line X3-X3 in FIG. 16.
Figure 19:
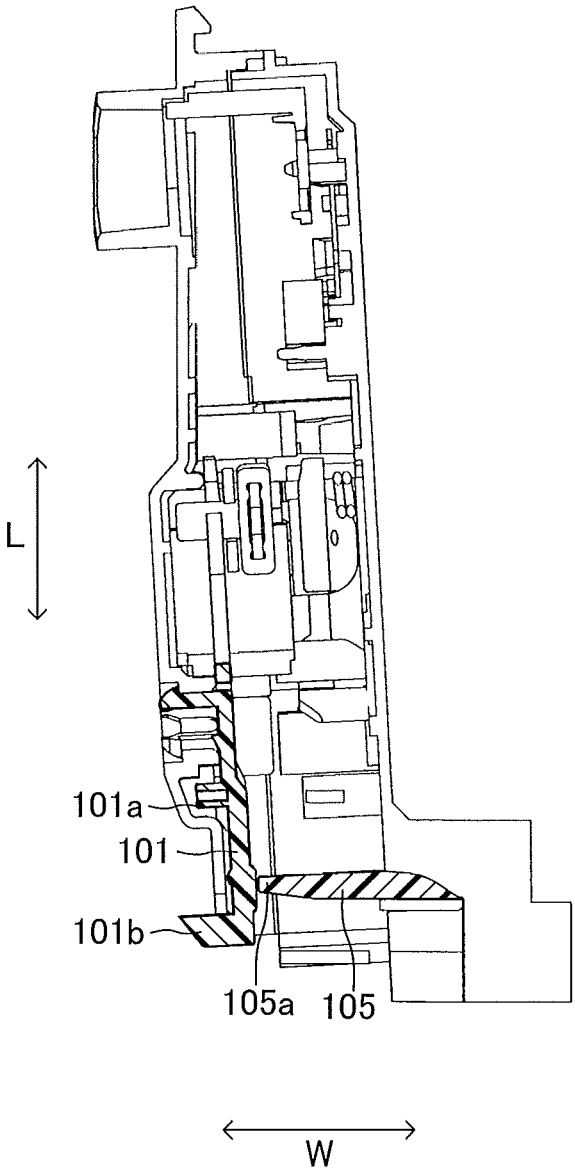
FIG. 19 is a schematic sectional view along the line X4-X4 in FIG. 17.
Figure 20:
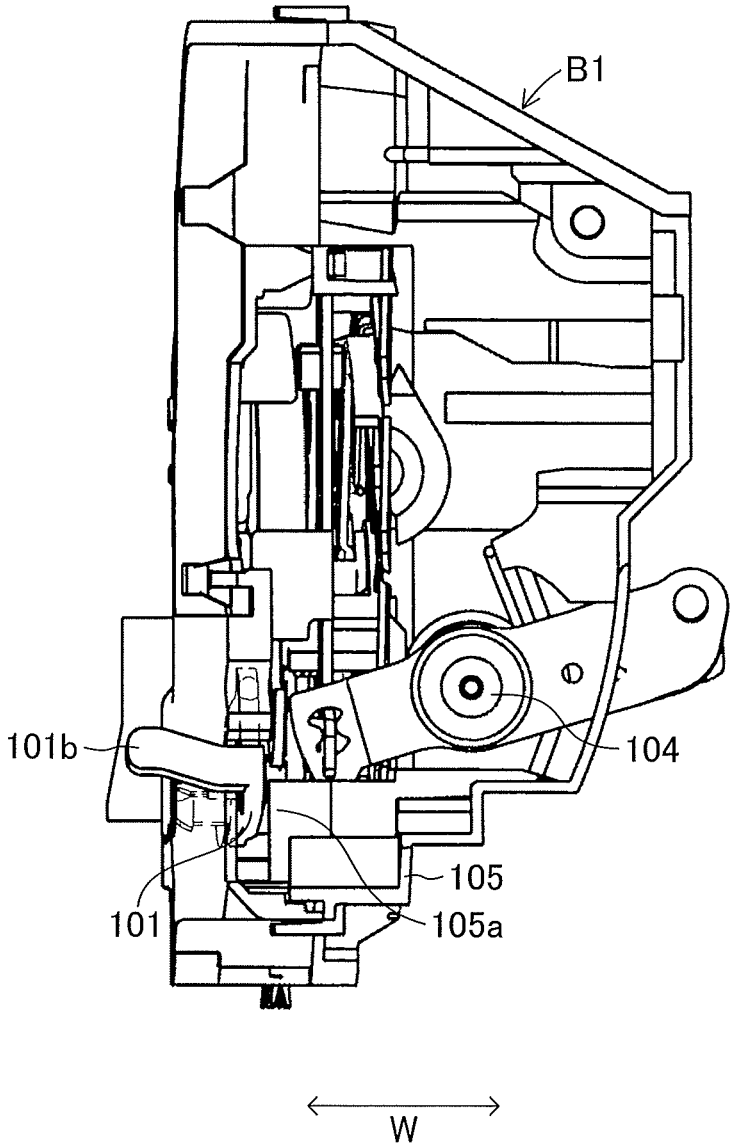
FIG. 20 is a side view of a housing unit of the conventional vehicle door locking device shown in FIGS. 16 to 18, the view seen from the rear side of the door.
Figure 21:
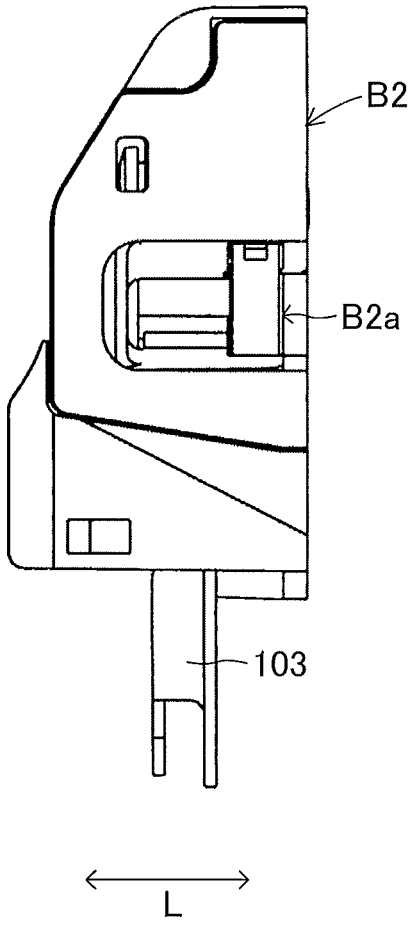
FIG. 21 is a side view of a base unit of the conventional vehicle door locking device shown in FIGS. 16 to 18, the view seen from the inside of the door.
Figure 22:
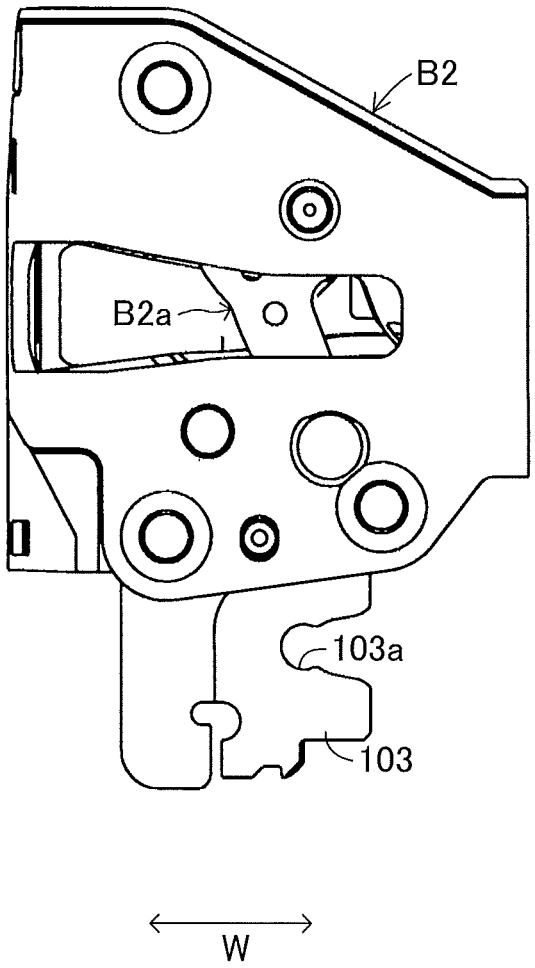
FIG. 22 is a side view of the base unit of the conventional vehicle door locking device shown in FIGS. 16 to 18, the view seen from the rear side of the door.

In this embodiment, as shown in FIG. 7, the receiving portion 27*b*, the outside open lever 31, and the open link 33 can be arranged and overlapped in the W direction (arrangement in the up and down direction of the receiving portion 27*b* is not limited by the outside open lever 31 and the open link 33). Thus, the child-proof lever 36 can be moved toward the upper side in the vehicle, so that a freedom degree of arrangement of the child-proof lever 36 can be improved. It should be noted as shown in FIG. 18, a conventional technique employs a configuration in which one part 105*a* of a housing 105 receives a child-proof lever 101, and an outside open lever 31 and an open link 33 are placed on the upper side of a receiving portion in a vehicle. Thus, the child-proof lever 101 has to be arranged on the lower side of the outside open lever and the open link in the vehicle so as not to come into contact with the outside open lever 31 and the open link 33. Therefore, a freedom degree of arrangement is limited.

The invention claimed is:

1. A vehicle door locking device, comprising:

a base unit adapted to be installed in a vehicle door and provided with a latch mechanism for retaining the vehicle door in a closed state relative to a vehicle body;

a housing unit provided with an actuating mechanism for actuating the latch mechanism;

a metal sub-base plate provided in the base unit for assembling the base unit to the housing unit;

a child-proof lever provided in the housing unit, the child-proof lever assembled to the housing unit oscillatably on an axis extending in the vehicle width direction when the housing unit is installed in the vehicle door through the base unit, the child-proof lever being manually operable and having an operation knob which extends toward the indoor side in the vehicle width direction;

a receiving portion provided in the metal sub-base plate, the receiving portion abutted with a back part of the child-proof lever at a base part of the operation knob so as to restrain a lean in the vehicle width direction of the operation knob;

a latch provided in the latch mechanism and configured to be engageable with a striker attached to the vehicle body; and a metal base plate provided in the base unit, the metal base plate supporting the latch along with the metal sub-base plate; wherein the receiving portion comprising a part of the metal sub-base plate bent toward a rotation axis direction of the latch.

2. The vehicle door locking device according to claim 1, wherein a support shaft extending in the vehicle length direction is provided in the housing unit, an attachment hole is provided in the metal sub-base plate and fitted to the support shaft in the axial direction thereof, and the base unit is assembled to and integrated with the housing unit by fitting the attachment hole to the support shaft.

3. The vehicle door locking device according to claim 2, wherein a positioning pin extending in the vehicle length direction is provided in the housing unit, and a positioning hole is provided in the metal sub-base plate and fitted to the positioning pin.

4. The vehicle door locking device according to claim 1, wherein a support shaft extending in the vehicle length direction is provided in the housing unit, an attachment hole is provided in the metal sub-base plate and fitted to the support shaft in the axial direction thereof, and the base unit is assembled to and integrated with the housing unit by fitting the attachment hole to the support shaft.

5. The vehicle door locking device according to claim 4, wherein a positioning pin extending in the vehicle length direction is provided in the housing unit, and a positioning hole is provided in the metal sub-base plate and fitted to the positioning pin.

* * * * *